US009618199B2

(12) United States Patent
Carpentier et al.

(10) Patent No.: US 9,618,199 B2
(45) Date of Patent: Apr. 11, 2017

(54) RADIATING BURNER HAVING ENHANCED PERFORMANCE AND METHOD FOR IMPROVING THE PERFORMANCE OF A RADIATING BURNER

(75) Inventors: Stéphane Carpentier, Paris (FR); David Dupuis, Ecouen (FR); Armelle Cessou, Rouen (FR); Pierre Vervisch, Rouen (FR)

(73) Assignee: GDF Suez, Courbevoie (FR)

( * ) Notice: Subject to any disclaimer, the term of this patent is extended or adjusted under 35 U.S.C. 154(b) by 1159 days.

(21) Appl. No.: 13/501,709

(22) PCT Filed: Oct. 20, 2010

(86) PCT No.: PCT/FR2010/052242

§ 371 (c)(1),
(2), (4) Date: May 21, 2012

(87) PCT Pub. No.: WO2011/048337

PCT Pub. Date: Apr. 28, 2011

(65) Prior Publication Data

US 2012/0231398 A1 Sep. 13, 2012

(30) Foreign Application Priority Data

Oct. 22, 2009 (FR) ..... 09 57405

(51) Int. Cl.
*F23D 14/14* (2006.01)
*F23C 99/00* (2006.01)

(52) U.S. Cl.
CPC ..... *F23C 99/00* (2013.01); *F23C 99/001* (2013.01); *F23D 14/14* (2013.01)

(58) Field of Classification Search
CPC ..... F23C 99/00; F23C 99/001; F23D 14/22; F23D 14/14
USPC ..... 431/8
See application file for complete search history.

(56) References Cited

U.S. PATENT DOCUMENTS

| | | | | |
|---|---|---|---|---|
| 4,846,671 | A * | 7/1989 | Kwiatek | 431/266 |
| 5,451,224 | A * | 9/1995 | Goble et al. | 606/48 |
| 6,445,129 | B1 * | 9/2002 | Seiler et al. | 313/594 |
| 2003/0051990 | A1 * | 3/2003 | Spielman | B01D 53/002 204/158.2 |
| 2007/0020567 | A1 | 1/2007 | Branston et al. | |

(Continued)

FOREIGN PATENT DOCUMENTS

| | | |
|---|---|---|
| DE | 33 03 541 A1 | 8/1984 |
| FR | 2 835 042 A1 | 7/2003 |
| FR | 2 905 001 A1 | 2/2008 |

*Primary Examiner* — Avinash Savani
*Assistant Examiner* — Rabeeul Zuberi
(74) *Attorney, Agent, or Firm* — Arent Fox LLP

(57) ABSTRACT

A method for improving the performance of a radiating burner designed to be supplied during operation by means of a flow (F) comprising a mixture of air and combustible gas. The burner includes a body defining a combustion chamber and provided with an inlet for the mixture; a porous wicking agent closes off the chamber in a non-sealing manner and is arranged downstream of the inlet in the direction of flow (F) of the mixture; and a distribution grid is arranged between the mixture inlet and the wicking agent. The method includes creating an electric field in the combustion chamber by applying an electric potential difference of at least 5 kV between the wicking agent and the distribution grid.

9 Claims, 1 Drawing Sheet

(56) References Cited

U.S. PATENT DOCUMENTS

| | | | | |
|---|---|---|---|---|
| 2007/0059654 | A1* | 3/2007 | Armanni | 431/8 |
| 2008/0044781 | A1 | 2/2008 | Stolyarenko et al. | |
| 2009/0060805 | A1* | 3/2009 | Muradov et al. | 422/186.04 |

* cited by examiner

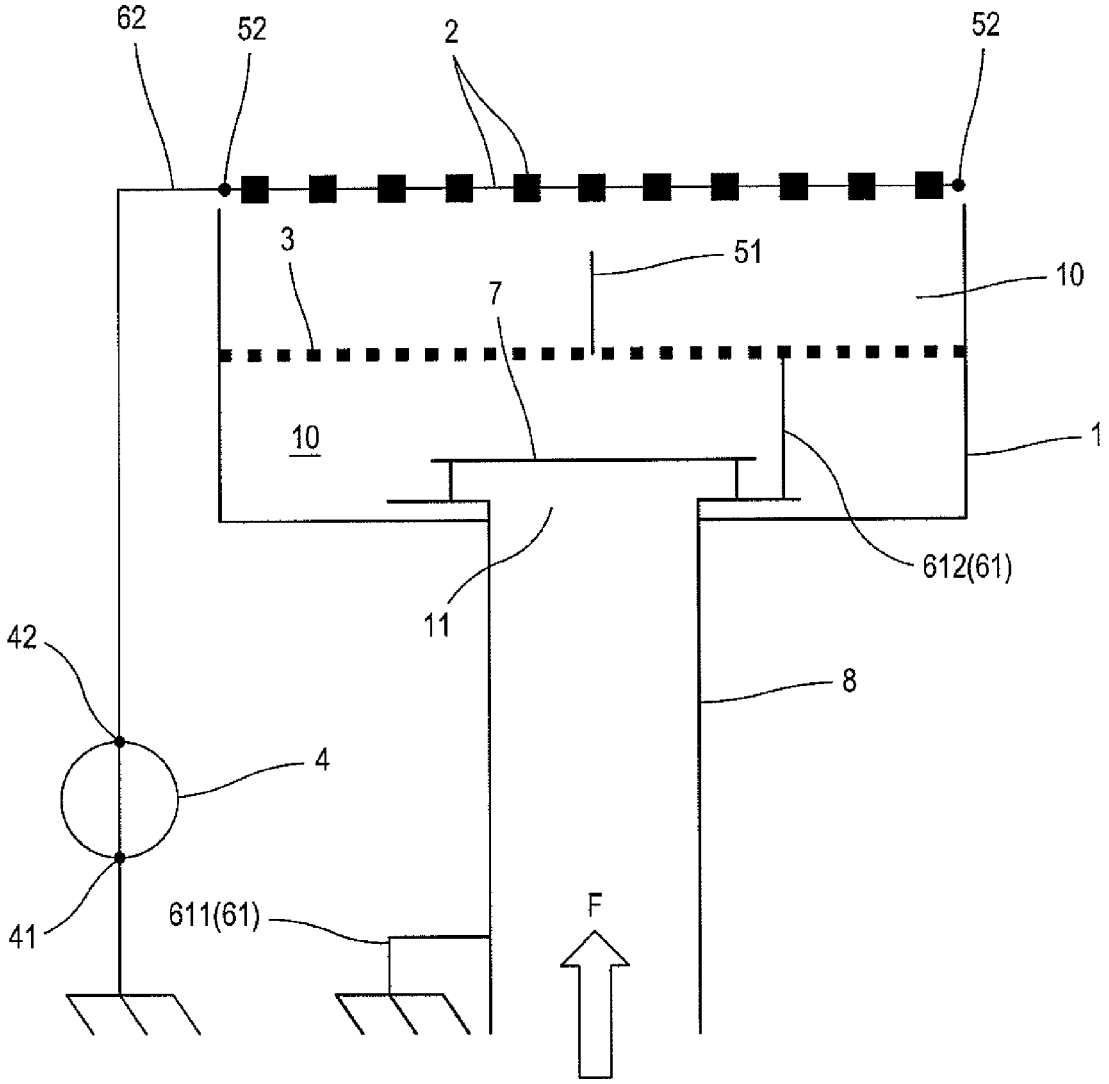
62
52
2
52
3
51
10
7
10
1
612(61)
11
42
8
4
41
611(61)
F

RADIATING BURNER HAVING ENHANCED PERFORMANCE AND METHOD FOR IMPROVING THE PERFORMANCE OF A RADIATING BURNER

CROSS-REFERENCE TO RELATED APPLICATION

This Application is a National Stage entry of International Application No. PCT/FR2010/052242, having an international filing date of Oct. 20, 2010; which claims priority to French Application No.: 0957405, filed Oct. 22, 2009; the disclosure of each of which is hereby incorporated in its entirety by reference.

The invention generally relates to the field of heating by infrared radiation.

More specifically, according to a first aspect, the invention relates to a radiating burner designed to be supplied, during operation, with a flow comprising a mixture of air and combustible gas, this burner comprising a body delimiting a combustion chamber and provided with an inlet for the mixture, a porous wicking agent closing off the chamber in a non sealing manner and being arranged downstream of the inlet in the direction of flow of the mixture, and a metallic distribution grid arranged between the inlet of the mixture and the wicking agent.

Heating by infrared radiation traditionally uses either one of the two energy sources constituted by the electricity on the one hand and the combustible gas on the other hand.

Each of these two energy sources (electricity and combustible gas) exhibit specific advantages which, according to the circumstances, may lead to prefer one over the other. For example, the advantage of combustible gas is that it has a greater storage capacity than electricity; however, it has a lower performance for generating heat by infrared radiation.

In this context, the purpose of the present invention is to provide means for increasing the performance of a combustible gas radiating burner.

To this end, the radiating burner of the invention, which is further in accordance with the generic definition given in the above preamble, is substantially characterized in that the body is made from a dielectric material, in that the burner further comprises an electric generator, first and second electrodes, and first and second galvanic connections, in that the electric generator is designed to supply during operation, between first and second terminals, a voltage having a continuous component at least equal to 5 kV, in that the first electrode is arranged on the distribution grid, in that the second electrode is arranged on the wicking agent, and in that the first and second galvanic connections respectively connect the first and second electrodes to the first and second terminals of the generator.

In a preferred embodiment of the invention, the first electrode comprises at least a metallic tip arranged on the distribution grid and oriented according to an axis pointing towards the wicking agent.

In this case, the second electrode may be arranged on the wicking agent, have the shape of a hollowed-out surface, such as a ring or a window, and surround the axis of the tip.

The wicking agent may be adequately made from ceramic or metal, the body itself being for example made from ceramic, and the second electrode from stainless steel.

In practice, it is desirable that the electric generator be designed to supply during operation a continuous voltage between 15 kV and 25 kV.

The burner of the invention may also comprise a deflector arranged in the body and a metallic duct, the duct directing the mixture and opening into the body at said inlet, and this inlet being covered by the deflector at least partially and in a non sealing manner.

It is also judicious to provide the first terminal of the electric generator such that it is grounded to the earth potential, and that the first galvanic connection comprises a metallic cable connecting the metallic duct to the earth potential, and a metallic wire connecting the metallic duct to the distribution grid.

The invention also relates to a method for improving the performance of a radiating burner designed to be supplied during operation with a flow of the mixture of air and combustible gas, this burner comprising a body delimiting a combustion chamber and provided with an inlet for the mixture, a porous wicking agent closing off the chamber in a non sealing manner and arranged downstream of the inlet in the flow direction of the mixture, and a distribution grid arranged between the inlet of the mixture and the wicking agent, this method includes an operation which comprises creating an electric field in the combustion chamber by applying an electric potential difference of at least 5 kV between the wicking agent and the distribution grid.

Other characteristics and advantages of the invention will become more apparent upon the reading of the following description, given only by way of non limiting reference, with reference to the accompanying drawing, the unique FIGURE of which is a diagram, representing, in axial cross-section, a burner in accordance with a possible embodiment of the invention.

As previously discussed, the invention particularly relates to a radiating burner designed to be supplied during operation with a flow F comprising a mixture of air and combustible gas.

Such a burner typically comprises a body 1, a porous wicking agent 2, and a metallic distribution grid 3.

The body 1, which delimits a combustion chamber 10, is provided with an inlet 11 for the mixture.

The wicking agent 2 closes off the chamber 10 in a non sealing manner, and is arranged downstream from the inlet 11 in the direction of flow F of the mixture.

The actual metallic distribution grid 3 is arranged between the inlet 10 of the mixture and the wicking agent 2.

According to the invention, the body 1 is made from a dielectric material, for example in ceramic, and the burner further comprises an electric generator 4, two electrodes 51 and 52, and two galvanic connections 61 and 62.

The electric generator 4, which comprises two terminals 41 and 42, is designed to supply between its terminals, during operation, a voltage exhibiting a continuous component at least equal to 5 kV.

Preferably, this electric generator supplies during operation a continuous voltage ranging between 15 kV and 25 kV and typically of about 20 kV.

The first electrode 51 is arranged on the distribution grid 3, and the second electrode 52, for example made from stainless steel, is arranged on the wicking agent 2.

Finally, the galvanic connections 61 and 62 have for function to respectively connect the electrodes 51 and 52 to the terminals 42 and 42 of the generator 4.

In the illustrated embodiment, the first electrode 51 is constituted of a metallic tip 51 arranged on the distribution grid 3 and oriented along an axis pointing towards the wicking agent 2.

The second electrode 52, which has the shape of a hollowed out surface such as a ring or a window, is itself arranged on the wicking agent 2 and surrounds the axis of the tip 51.

The electrodes 51 and 52 may however take other forms. For example, the first electrode 51 may have the shape of a plurality of tips, and the shapes of electrodes 51 and 52 may be inverted.

The wicking agent 2 may be made from metal or ceramic, for example from cordierite.

As the FIGURE shows, the burner also advantageously comprises a deflector 7 arranged in the body 1, as well as a metallic duct 8 able to form or comprise a venturi (not represented) which makes it possible to produce the air/combustible gas mixture.

This mixture is directed right to the chamber 10 by the duct 8 which opens into the body 1 at the inlet 11, this inlet 11 being covered at least partially and in a non sealing manner by the deflector 7.

Preferably, the first terminal 41 of the electric generator 4 is grounded to the earth potential, and the first galvanic connection 61 comprises for example a metallic cable 611 connecting the metallic duct 8 to the earth potential, and a metallic wire 612 connecting the metallic duct 8 to the distribution grid 3.

The presence of an electric field in the combustion chamber 10, obtained by applying a difference of electric potential of at least 5 kV between the wicking agent 2 and the distribution grid 3, makes it possible to increase the performance of the radiating burner.

Tests have been carried out with a radiating burner comprising the following members:

- a body 1 in ceramic of Usinit 1100 type;
- a wicking agent 2 in untreated ceramic of cordierite type with a honeycomb structure with 62 cells per square centimeter, of dimensions 150 mm×150 mm×15 mm;
- a metallic distribution grid 3, of dimensions 140 mm×140 mm; this grid being perforated with 3 mm-diameter holes and arranged in the chamber 10 at a distance of 50 mm with respect to the inlet 11;
- a metallic deflector 7 of dimensions 30 mm×40 mm arranged on the bottom of the chamber 10;
- a metallic duct 8 provided with a venturi (not illustrated);
- an electric generator 4 supplying a continuous voltage of 15 kV;
- an electrode 51 constituted of a metallic tip arranged in the centre of the distribution grid 3;
- a metallic electrode 52 in stainless steel, having the shape of a hollowed out surface such as a ring or a window, being arranged on the contour of the wicking agent 2 and being connected to the high voltage terminal 42 of the generator by a cable 62;
- a metallic cable 611 connecting the metallic duct 8 to the earth potential, to which the ground terminal 41 of the generator 4 was also connected; and
- a metallic wire 612 connecting the metallic duct 8 to the distribution grid 3.

The efficiency gain noticed on these tests and resulting from the application of an electric field is of about 10%.

The invention claimed is:

1. A radiating burner designed to be supplied during operation with a flow (F) comprising a mixture of air and combustible gas, the burner comprising:

- a body delimiting a combustion chamber and provided with an inlet for the mixture;
- a porous wicking agent closing off the chamber in a non sealing manner and arranged downstream of the inlet in the direction of flow (F) of the mixture; and
- a metallic distribution grid arranged between the inlet of the mixture and the porous wicking agent,
- characterized in that the body is made from a dielectric material, in that the burner further comprises an electric generator, first and second electrodes, and first and second galvanic connections, in that the electric generator is designed to provide, during operation, between the first and second terminals, a voltage exhibiting a continuous component at least equal to 5 kV,
- wherein the first electrode is arranged on the distribution grid and the second electrode is arranged on the porous wicking agent,
- wherein the second electrode has the shape of a hollowed-out surface,
- wherein the first and second galvanic connections respectively connect the first and second electrodes to the first and second terminals of the generator, and
- wherein the first electrode comprises at least a metallic tip arranged on the distribution grid and oriented along an axis pointing towards the porous wicking agent.

2. The radiating burner according to claim 1, characterized in that the second electrode surrounds the axis of the tip.

3. The radiating burner according to claim 1, characterized in that the porous wicking agent is made from ceramic or metal.

4. The radiating burner according to claim 1, characterized in that the body is made from ceramic.

5. The radiating burner according to claim 1, characterized in that the electric generator is designed to supply during operation a continuous voltage ranging between 15 kV and 25 kV.

6. The radiating burner according to claim 1, characterized in that the second electrode is made from stainless steel.

7. The radiating burner according to claim 1, characterized in that it further comprises a deflector arranged in the body and a metallic duct, the duct directing the mixture and opening into the body at said inlet, and this inlet being covered at least partially and in a non sealing manner by the deflector.

8. The radiating burner according to claim 7, characterized in that the first terminal of the electric generator is grounded to the earth potential, and in that the first galvanic connection comprises a metallic cable connecting the metallic duct to the earth potential, and a metallic wire connecting the metallic duct to the distribution grid.

9. A method for improving the performance of a radiating burner to be supplied during operation with a flow (F) comprising a mixture of air and combustible gas, the burner comprising:

- a body delimiting a combustion chamber and provided with an inlet for the mixture,
- a porous wicking agent closing off the chamber in a non sealing manner and arranged downstream of the inlet in the direction of flow (F) of the mixture,
- a distribution grid arranged between the inlet of the mixture and the porous wicking agent,
- a first electrode, and
- a second electrode,
- wherein the first electrode is arranged on the distribution grid and the second electrode is arranged on the porous wicking agent, the second electrode having the shape of a hollowed-out surface,
- the method comprising a step of creating an electric field in the combustion chamber by applying an electric potential difference of at least 5 kV between the first electrode and the second electrode.

* * * * *